US005785253A

United States Patent [19]

Ueberschär et al.

[11] Patent Number: 5,785,253

[45] Date of Patent: Jul. 28, 1998

[54] APPLICATION UNIT FOR THE DIRECT OR INDIRECT APPLICATION OF A LIQUID OR PASTY MEDIUM ONTO A MOVING MATERIAL WEB

[75] Inventors: Manfred Ueberschär, Nattheim; Eckard Wozny; Eckhart Krägeloh, both of Heidenheim, all of Germany

[73] Assignee: Voith Sulzer Papiermaschinen GmbH, Heidenheim, Germany

[21] Appl. No.: 524,030

[22] Filed: Sep. 6, 1995

[30] Foreign Application Priority Data

Sep. 9, 1994 [DE] Germany ..... 44 32 177.5
Apr. 21, 1995 [DE] Germany ..... 195 14 772.3

[51] Int. Cl.[6] ..... B05B 1/32

[52] U.S. Cl. ..... 239/455; 239/597; 118/63

[58] Field of Search ..... 239/101, 451, 239/455, 456, 459, 460, 537, 597, 598; 118/63

[56] References Cited

U.S. PATENT DOCUMENTS

| | | | |
|---|---|---|---|
| 2,940,418 | 6/1960 | Penrod et al. . | |
| 3,841,557 | 10/1974 | Atkinson | 239/597 X |
| 4,106,429 | 8/1978 | Phillips | 118/63 |
| 4,250,211 | 2/1981 | Damrau et al. | 118/411 X |
| 4,251,566 | 2/1981 | Gingerich . | |
| 4,455,197 | 6/1984 | Croteau et al. | 162/343 |
| 4,749,125 | 6/1988 | Escallon et al. | 239/3 |

FOREIGN PATENT DOCUMENTS

| | | | |
|---|---|---|---|
| 491209 | 3/1953 | Canada | 118/63 |
| 0041729 | 6/1981 | European Pat. Off. . | |
| 3731961 | 4/1989 | Germany . | |
| 3834719 | 4/1990 | Germany . | |
| 4327701 | 2/1995 | Germany . | |
| 2157595 | 6/1987 | United Kingdom . | |
| 2272390 | 5/1994 | United Kingdom | 118/63 |
| WO9516074 | 6/1995 | WIPO . | |

*Primary Examiner*—Andres Kashnikow
*Assistant Examiner*—Steven J. Ganey
*Attorney, Agent, or Firm*—Sughrue, Mion, Zinn, Macpeak & Seas, PLLC

[57] ABSTRACT

An application unit for the direct or indirect application of a liquid or pasty medium onto a moving material web includes a dosing gap formed as a free jet nozzle. The dosing gap is formed between a leading lip and a trailing lip. The leading lip is adjustable along the length of the application unit in terms of its distance from the trailing lip. A gap adjustment can be carried out during the operation of the application unit by an adjusting device.

11 Claims, 6 Drawing Sheets

FIG. 3
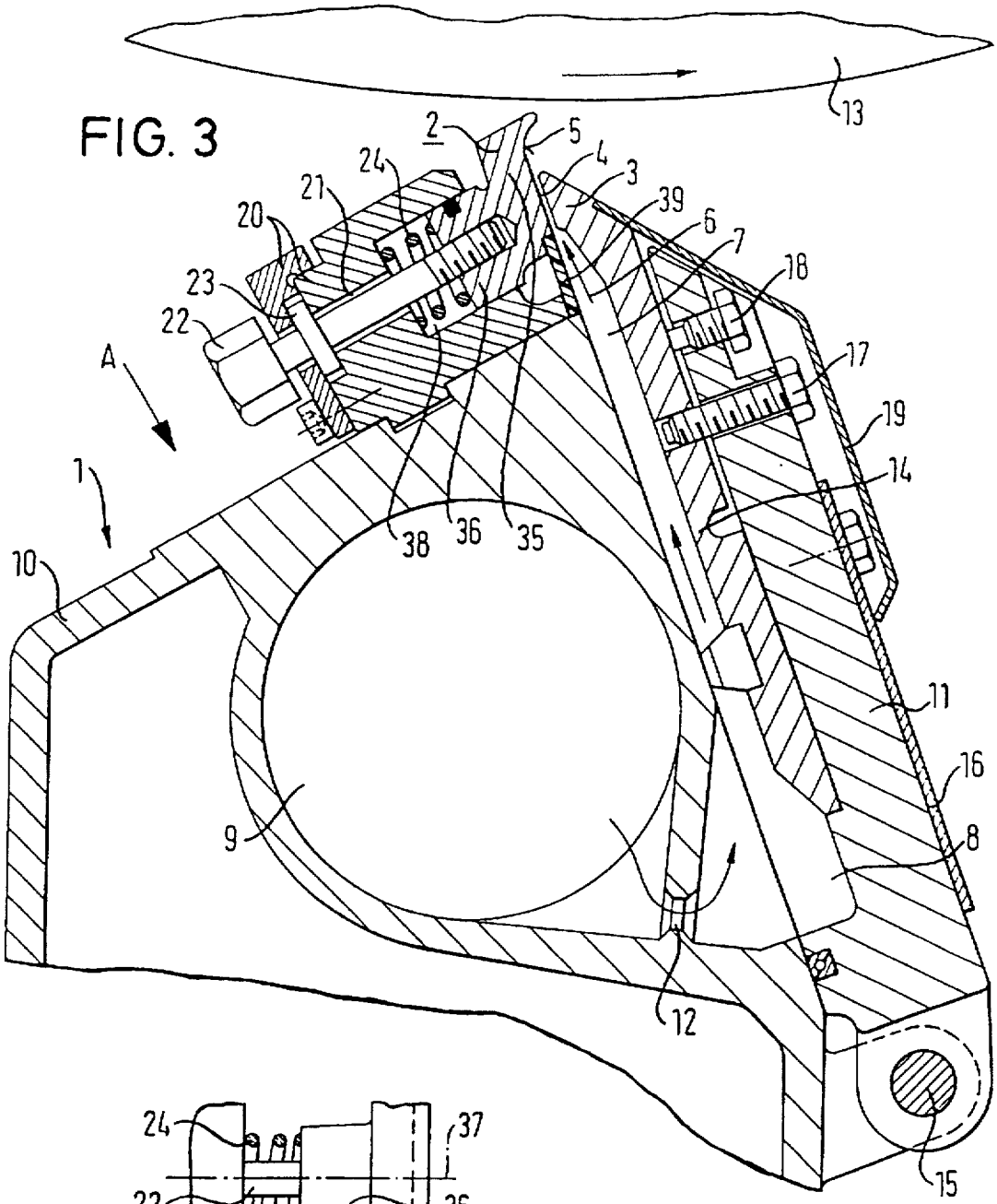
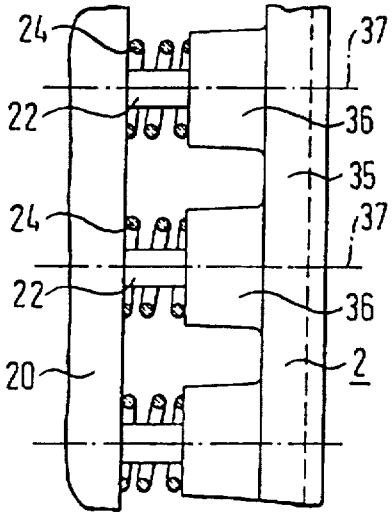
FIG. 4

APPLICATION UNIT FOR THE DIRECT OR INDIRECT APPLICATION OF A LIQUID OR PASTY MEDIUM ONTO A MOVING MATERIAL WEB

BACKGROUND OF THE INVENTION

The invention relates to an application unit for the direct or indirect application of a liquid or pasty medium onto a moving material web, in particular of paper or board.

Application units are known in which a dosing gap is formed between two lips and operates as a free jet nozzle. Such application units are also described as a "Fountain Jet Flow Applicator" on account of the formation of a free jet of the liquid or pasty medium which passes through the surrounding atmosphere. The liquid or pasty medium is applied directly or indirectly with this onto a moving material web.

In these application units, the liquid or pasty medium is supplied via a colour distribution pipe which is arranged within a beam extending along the length of the application unit. The medium enters from the colour distribution pipe via outlet openings into an equalizing space and flows from there via a supply gap to the dosing gap, out of which the liquid or pasty medium is subsequently discharged in the form of a free jet. When directly applying the medium, a material web moves past the free jet nozzle and is impinged upon directly by the free jet of the liquid or pasty medium. In this case, for example, the material web can be guided on the surface of a roll. When indirectly applying the medium, the free jet is initially applied onto the surface of an applicator roll in order to be transferred from the applicator roll onto the material web in a roll gap through which the material web passes. Of the two lips forming the dosing gap, the lip which lies on the side of the dosing gap at which, in the case of indirect application of the medium, the applicator roll or, in the case of direct application of medium, the material web respectively moves towards the application unit is described as the leading lip. Accordingly, the second lip which lies on the side of the dosing gap at which the applicator roll or the material web respectively moves away from the application unit is described as the trailing lip.

Traditionally, in application units of the previously described type, an adjusting device is provided at the trailing lip by means of which the trailing lip is adjustable zone-wise along the length of the application unit in terms of its distance from the leading lip. This adjustment of the dosing gap ensues when the application unit and, therefore, the associated coating unit is at a standstill in order to achieve a certain cross section of the liquid or pasty medium applied onto the material web. In this case, the adjusting device in commonly known application units is only accessible with difficulty because, as a rule, a fine dosing device is arranged downstream of the free jet application unit for doctoring the applied liquid or pasty medium to the desired cross section by means of a blade member, for example a doctor blade. Furthermore, a collecting trough is arranged between the trailing lip of the application unit and the fine dosing device to collect excess liquid or pasty medium which runs off the application unit or the fine dosing device. On account of these conditions and the liquid or pasty medium running off the application unit during operation, the gap adjustment cannot be carried out in such commonly known application units during running operation.

SUMMARY OF THE INVENTION

The invention is therefore based on the technical problem of being able to carry out a gap adjustment of the dosing gap in an application unit of the type initially described also during running operation.

The invention is directed to an application unit for the direct or indirect application of a liquid or pasty medium onto a moving material web, in particular of paper or board, comprising a dosing gap formed as a free jet nozzle which is formed between a leading lip and a trailing lip, and an adjusting means by means of which the leading lip is adjustable zone-wise along the length of the application unit in terms of its distance from the trailing lip.

The invention is also directed to an application unit for the direct or indirect application of a liquid or pasty medium onto a moving material web, in particular of paper or board, comprising a dosing gap formed as a free jet nozzle which is formed between a leading lip and a trailing lip, wherein the leading lip is connected with a number of adjusting spindles distributed along the length of the application unit and the leading lip is adjustable zone-wise along the length of the application unit in terms of its distance from the trailing lip, each adjusting spindle is rigidly connected to the leading lip and in a manner protected against twisting, and each adjusting spindle is capable of adjustment in an axial direction relative to a supporting means of the application unit by means of an adjusting means.

An adjusting means is provided in accordance with the inventive solution by means of which the leading lip is adjustable in terms of its distance to the trailing lip. In this case, seen along the length of the application unit, this distance can be varyingly adjusted zone-wise in order to equalize local finishing accuracies or to realize a cross section of the applied liquid or pasty medium which is different in different portions for example, flattened at the edges of the material web. Naturally, a preadjustment of the entire dosing gap extending along the length of the application unit is also possible.

In this solution in which the adjusting means can be arranged on the inlet side of the application unit, the gap adjustment can also be carried out during the running operation because the accessibility of the adjusting means is not impaired by a fine dosing device or a runoff trough at the outgoing or trailing side. Additionally, in the inventive solution, attendance of the adjusting means is not impaired by running off liquid or pasty medium because this is collected in the trailing region of the application unit. On account of the possibility of gap adjustment during the running operation, it is possible to directly react to changes in the cross section of the applied medium occurring during operation and the costs of operating the coating unit can be reduced because longer down times for a gap adjustment in the application unit can be avoided.

In useful embodiments of the invention, the leading and trailing lips can have surface portions bordering the dosing gap which are either straight or curved. Thus, the surface portions of both lips can be respectively straight or respectively curved. Additionally, one of the two lips can be designed at its free end to extend beyond the other lip in order to form a curved deflection surface at this extended portion for the liquid or pasty medium to be applied. It is particularly preferred that the leading lip has a concavely curved deflection surface for the liquid or pasty medium at its free end. In principle, however, such a deflection surface can also be convexly curved or the free end of one of the lips can extend beyond the free end of the second lip as a straight guiding surface portion.

In a preferred embodiment, the leading lip can be comb-shaped. In another words, the leading lip has a continuous web along its length from which there extend extensions or projections distributed along the length. By such a design, the lip can more easily be deformed by exerting forces via the extensions or projections and a zone-wise varied gap adjustment can be easily realized in this manner.

In an advantageous embodiment of the invention, the leading lip is moveable zone-wise by means of the adjusting means in a rotary manner about an axis extending parallel to the longitudinal axis of the application unit. In other words, the lip can be swung sectionally about this axis parallel to its longitudinal axis to thus reduce the dosing gap by pivoting the lip towards the trailing lip or to enlarge the dosing gap by pivoting away from the trailing lip.

In another useful embodiment, the leading lip is moveable zone-wise by the adjusting means in a translatory manner in a direction extending perpendicular to the plane of the dosing gap. This means that the leading lip can be moved towards or away from the trailing lip by sections in order to accordingly reduce or enlarge the dosing gap.

In a useful embodiment, the adjusting means has a mechanical adjusting mechanism. Such a mechanical adjusting mechanism can be designed in a multitude of ways, for example by using adjusting screws, levers or the like. A preferred embodiment of the mechanical adjusting mechanism consists in a number of adjusting screws distributed along the length of the application unit which are directly or indirectly supported on the cross piece or beam of the application unit and are threadingly engaged with the leading lip, the adjusting screws being biased by spring elements. Thus, by turning the adjusting screws, the leading lip can be pulled or pivoted away from the trailing lip or pushed or pivoted towards this. By actuating individual adjusting screws, a local gap adjustment can be carried out while an equal actuation of all adjusting screws can create a total adjustment of the dosing gap along the length of the application unit. It is always ensured by means of the pretensioning of the adjusting screws that a stable gap adjustment without play is provided.

A further advantageous embodiment of the mechanical adjusting mechanism consists in providing a lever arm arrangement which exerts bending forces on the leading lip by means of adjusting members distributed along the length of the application unit in order to adjust the dosing gap zone-wise by means of the resulting bending deformations. As in the previously described embodiment, a zone-wise gap adjustment can be carried out by actuating individual adjusting members to locally apply bending forces on the leading lip by means of the lever arm arrangement and, in a similar manner, by actuating all adjusting members, a total gap adjustment along the length of the application unit can be performed.

Further advantageous embodiments of the adjusting means consist in providing a thermal, hydraulic, pneumatic, magnetic, magnetostrictive or piezoelectric adjusting mechanism. Such adjusting mechanisms can be realized in various ways in terms of their structural design, it being possible to also carry out different combinations of the adjusting mechanisms/operating principles, or combinations of these adjusting mechanism/operating principles with mechanical adjusting mechanisms.

In a useful embodiment of the invention, servo-motors can be provided for zone-wise actuation of the adjusting means. Thus, the adjusting process if simplified because the adjusting members such as the adjusting screws or the like no longer need to be actuated by hand.

In a preferred embodiment, the adjusting means are capable of being actuated in a remote-controlled manner. This embodiment of the invention is advantageous particularly with respect to a gap adjustment during the running operation because, on the one hand, the control of the adjusting means can ensue centrally and, on the other hand, a coupling in control terms of the adjusting means with other components of the coating unit is made possible. It is particularly advantageous to incorporate the remote controlled zone-wise control of the adjusting means in an automatic control circuit which readjusts the adjusting means on the basis of measured values of the cross section of the applied liquid or pasty medium. Therefore, the gap adjustment is automized in this embodiment during operation of the coating unit, on account of which the quickest possible adaptation of the application unit to changing conditions or irregularities is provided during operation and, in this manner, the quality of the final product is improved.

An equipping of the adjusting means with automatically actuatable adjusting members or servo-motors is practically not possible for the trailing lip in commonly known application units having an adjusting means because there is not sufficient space available for such devices on account of the collecting trough arranged directly to the rear of the lip and on account of the fine dosing unit downstream thereof.

In a further advantageous embodiment of the invention, as an addition to the adjusting means for the leading lip, there is provided a second adjusting means for the trailing lip by means of which the trailing lip is adjustable zone-wise along the length of the application unit in terms of its distance to the leading lip. In so far as the spatial conditions permit, this second adjusting means is designed according to one of the embodiments explained above in connection with the adjusting means for the leading lip. It is preferred in this case to design the adjusting means for the leading lip for a fine adjustment of the dosing gap and the additional adjusting means for the trailing lip for a coarse adjustment of the dosing gap. The preadjustment of the gap width as a whole can then take place by means of the adjustment means for the trailing lip in the usual manner when the coating unit is at a standstill while the sectional fine adjustment can be carried out during operation by adjustment of the adjusting means for the leading lip.

In another inventive solution, relatively large forces are capable of being transferred during the gap adjustment. Furthermore, the adjustment of the gap width of the dosing gap is carried out without play, precisely and very sensitively. The gap adjustment ensues in a very simple manner and angular changes are capable of being compensated during the gap adjustment, i.e. unpermitted deformations of the adjusting spindles are capable of being avoided.

In an advantageous embodiment of the invention, the adjusting means is a nut which is arranged on a threaded part of the adjusting spindle and by means of which the leading lip is adjustable with respect to its distance from the trailing lip and, thus, the width of the dosing gap.

Preferably, the adjusting spindle is associated with a spring element. It is advantageous that the spring element is supported on a structural component of fixed location and exerts force on the adjusting spindle in the direction of "closing" or "opening" of the dosing gap.

In a preferred embodiment, each adjusting spindle has a bending part. Advantageously, the bending part is in the form of a leaf-spring-like thin part.

It is preferable that the wide side of the leaf-spring-like thin part extends along the horizontal axis of the adjusting spindle, the thin part being elastically deformable about an axis extending parallel to the longitudinal axis of the application unit.

Preferably, the spring element is capable of being biased by means of a pretensioning nut.

BRIEF DESCRIPTION OF THE DRAWINGS

Exemplary embodiments of the invention are now explained in more detail in the following with reference to the enclosed figures, in which:

FIG. 3 shows a schematic cross-sectional illustration of a third exemplary embodiment of the inventive application unit;

FIG. 4 shows a portion of a partially sectioned top plan view in the direction of arrow A onto the leading lip and the associated adjusting means in FIG. 3;

DETAILED DESCRIPTION OF THE INVENTION

Figure 1:
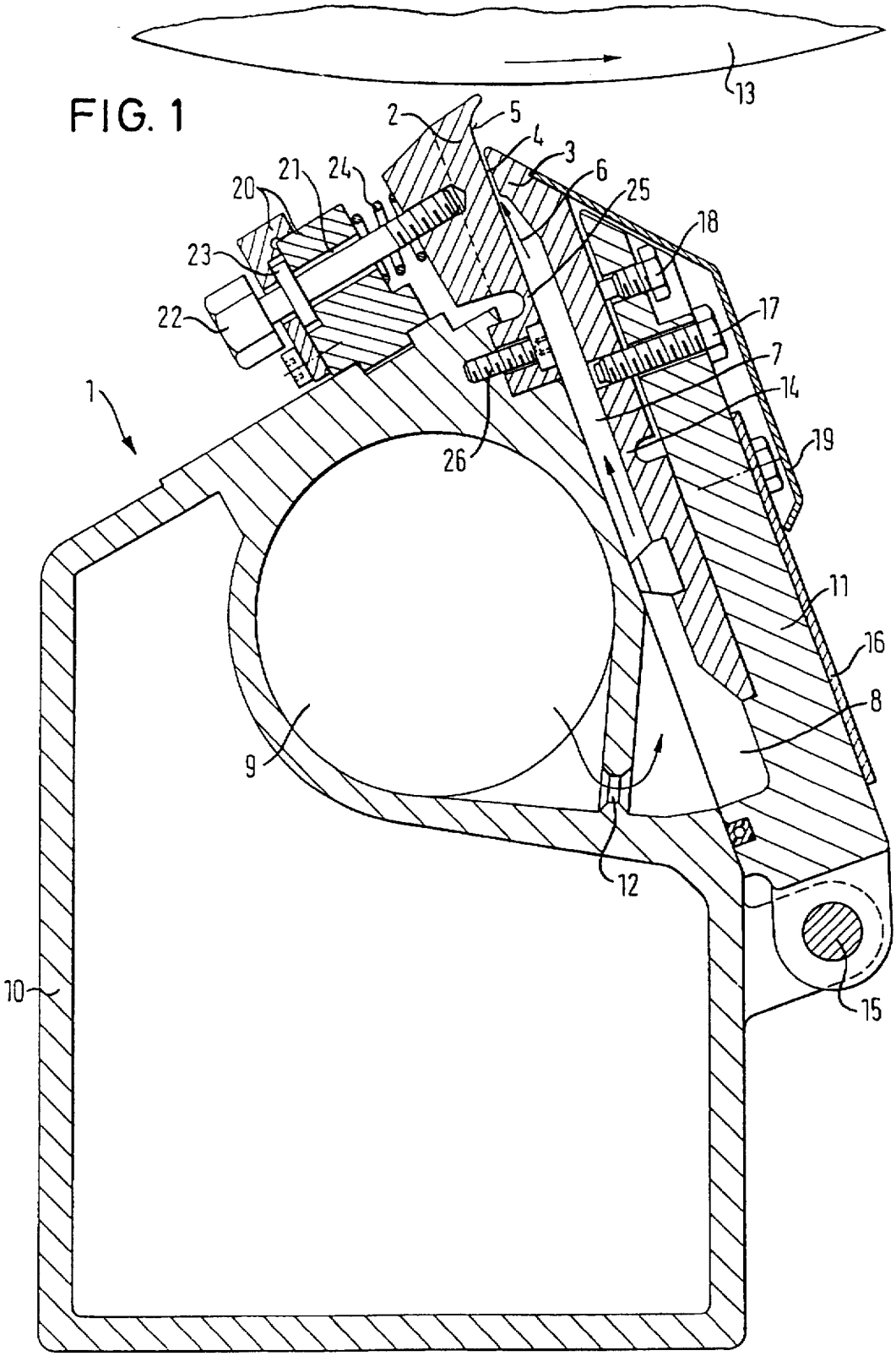
FIG. 1 shows a schematic cross-sectional illustration of a first exemplary embodiment of the inventive application unit.

As shown in FIG. 1, a first exemplary embodiment of the application unit 1 includes a cross piece 10 which extends the entire length of the application unit. A distribution pipe 9 is formed in the cross piece 10 for the liquid or pasty medium to be applied and which is usually described as a colour distribution pipe. Connected via through-openings 12, this pipe is joined with an equalizing space 8 which passes into a supply channel 7. The supply channel 7 opens into a dosing gap 4 which is formed between a leading lip 2 and a trailing lip 3. At the free end of the leading lip 2 which extends beyond the free end of the trailing lip 3, there is a concavely curved deflection surface 5. The liquid or pasty medium is indicated by arrows 6.

Opposite the application unit 1 there is an applicator roll 13 for indirect application of the medium to be applied. The direction of rotation of the applicator roll 13 is indicated by an arrow. As can be seen in the drawing, the leading lip 2 lies on the side of the dosing gap 4 at which the applicator roll 13 is incoming, i.e. leads in, while the trailing lip 3 lies at the opposite side of the dosing gap at which the applicator roll 13 is outgoing, i.e. trails away.

The liquid or pasty medium 6 is first supplied in this application unit 1 by means of the colour distribution pipe 9, then arrives in the equalizing space 8 and flows through the supply channel 7 to the dosing gap 4, from where the medium is then discharged as a free jet (not illustrated), a deflection of the application jet in the direction of a tangent to the applicator roll 13 taking place by means of the concavely curved deflection surface 5. The liquid or pasty medium 6 is applied in the form of this free jet onto the surface of the applicator roll 13 and, after passing a fine dosing device arranged downstream (not illustrated) at which the applied medium is doctored to set a predetermined cross section or profile, it is then supplied to a roller gap through which there moves a material web of paper or board, also possibly a textile material, which takes up the liquid or pasty medium from the applicator roll 13 at this location.

The exemplary embodiment is equipped both with an adjusting means for the leading lip 2 as well as an adjusting means for the trailing lip 3.

The adjustment means for the trailing lip 3 is designed in a known manner, the trailing lip 3 having a thin part 14. The thin part 14 corresponds to a hinged connection and permits a pivoting within a certain pivoting range of the section of the trailing lip 3 lying above the thin part in the drawing, the pivoting ensuing about an axis extending through the thin part 14 and parallel to the longitudinal axis of the cross piece 10. A front wall 11 to which the trailing lip 3 is securely connected at its portion lying beneath the thin part in the drawing is rigidly fixed in operation, but can be swung open about a pivot 15 if necessary, for example for cleaning purposes. The rear side of the front wall 11 is formed as a runoff surface 16 for excess liquid or pasty medium. In the region lying above the thin part 14 in the drawing, adjusting screws 17 are arranged along the longitudinal extension of the application unit which are supported at their heads on the rear side of the forward wall 11 and are in threaded engagement with the pivotable section of the trailing lip 3. Further, distributed along the longitudinal extension of the application unit are stop screws 18 which are in threaded engagement with the front wall 11 and supported at their both ends at the pivotable part of the trailing lip 3. Finally, another cover 19 is arranged at the rear side of the front wall 11 which protects the adjusting means and serves as a runoff surface for the excess medium 6.

By rotating the adjusting screws 17 in the appropriate direction, the upper part of the trailing lip 3 in the drawing can be pivoted about the thin part 14 either towards the leading lip 2 or away from this. Depending on whether only individual or all adjusting screws 17 are actuated, locally limited gap adjustments or a total adjustment of the gap along the length of the application unit are obtained. By actuating the stop screws 18, it is ensured that the pivotable section of the trailing lip 3 and the front wall 11 are clamped to each other such that a gap setting which is free of play is provided. In order to carry out the gap adjustment by means of the previously described adjusting mechanism for the trailing lip 3, the coating unit must be at a standstill because the adjusting and stop screws would otherwise not be accessible. This is because a collecting trough (not illustrated) is arranged on the front wall 11 during operation and blocks the area between the application unit 1 and a fine dosing device arranged downstream thereof (also not illustrated). Further, an excess of medium 6 to be applied flows over the cover 19 and the runoff surface 16 during operation so that access to the adjusting means is also blocked for this reason.

The adjusting means for the leading lip 2 is now described in the following. A two-part flange element 20 is securely arranged on the cross piece 10 and provided with through-bores 21 for receiving adjusting screws 22. The adjusting screws 22 are arranged along the longitudinal extension of the cross piece 10. The adjusting screws are supported on the flange element 20 by means of a shoulder 23 while they are in threaded engagement with the leading lip 2 by means of their free bolt ends. The flange element 20 and the leading lip 2 are biased apart by means of a pressure spring 24 which is arranged around the free bolt section of each adjusting screw 22. The leading lip 2 is provided with a thin part 25 so that part of this lip lying above the thin part in the drawing is capable of being pivoted within a certain range. The leading lip 2 is secured to the cross piece 10 at its part lying below the thin part 25 in the drawing by means of fastening screws 26.

By rotating individual or all adjusting screws 22, local sections of the leading lip 2 or the entire leading lip 2 are pivoted either away from the trailing lip 3 or towards this, the pivoting ensuing about an axis extending through the thin part 25 and parallel to the longitudinal axis of the cross piece 10 of the application unit.

The adjustment means for the trailing lip 3 is provided for the coarse adjustment of the gap width of the dosing gap 4, while the adjusting means for the leading lip 2 serves for a fine setting of the gap width of the dosing gap 4. For this purpose, the adjusting screws 22 are provided with a fine thread which permits a precise fine adjustment. On account of the biasing effect of the pressure springs 24, which can, for example, alternatively be designed as disc springs, a stable adjustment of the leading lip 2 free of play is always ensured.

Figure 2:
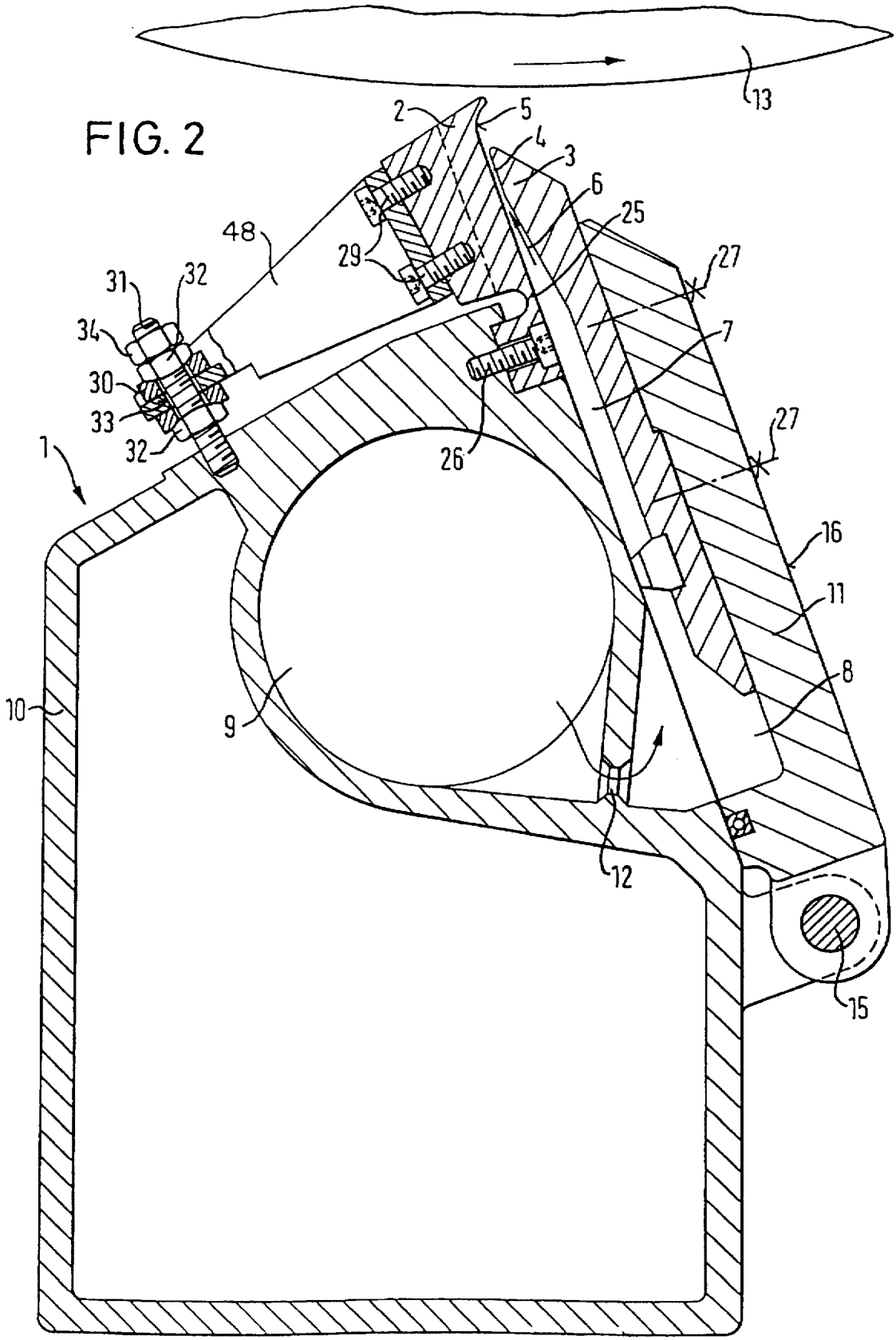
FIG. 2 shows a schematic cross-sectional illustration of a second exemplary embodiment of the inventive application unit.

In the second exemplary embodiment shown in FIG. 2, the same or corresponding components of the application unit are denoted with the same reference signs as in the case of the first exemplary embodiment so that reference is made in respective of these components to the description of the first exemplary embodiment. Reference is also made with respect to the mode of operation of this application unit to the explanations concerning the first exemplary embodiment.

In contrast to the first exemplary embodiment, no adjusting means are provided on the trailing lip 3 for adjusting this lip and the lip 3 is securely connected with the front wall 11 by clearly schematically illustrated connecting screws 27. Therefore, the trailing lip 3 does not have a thin part as in the first exemplary embodiment.

The adjusting means for the leading lip 2 is explained in the following. The design of the leading lip 2 with a thin part 25 which subdivides the lip into a pivotable part and a part securely connected to the cross piece 10 by means of fastening screws 26 correspond substantially to the first exemplary embodiment. Lever arms 48 are distributed across the length of the application unit and securely connected with the leading lip 2 by means of fastening screws 29. The pivot heads 30 are respectively pushed onto a screw bolt 31 rigidly mounted to the cross piece 10 and held there between respectively two screw nuts 32. The screw nuts 32 respectively have a ball calotte-shaped surface at their end facing the pivot head 30. This surface is respectively adapted to a pivoting socket, which is adapted to the ball calotte, on the end faces of the pivot head 30. Since a through-bore 33 of each ball head 30 has a larger inner diameter than the outer diameter of the rigid bolt 31, the pivot head 30 can be pivoted within a certain range with reference to the bolt 31 without transferring bending forces to the bolts. Both nuts 32 on each bolt 31 are additionally secured by a counternut 34.

In contrast to the first exemplary embodiment in which one adjusting means is provided for the trailing lip for coarsely adjusting the dosing gap and one adjusting means is provided for the leading lip for finely adjusting the dosing gap, the adjusting means here for the leading lip 2 in this case takes over the entire gap adjusting function. The adjusting means for the leading lip according to the first exemplary embodiment only allows smaller adjusting distances because the adjusting screws 22 would otherwise experience an unpermitted bending at the entrance into the threaded bores of the leading lip 2. However, for a fine setting of the dosing gap, the realizable adjusting distance is entirely sufficient. As substantially larger adjusting distances must be realized in the second exemplary embodiment, there is a pivoted connection between the rigid lever arms 48 and the rigid bolts 31 so that the displacements of the lever arm 48 produced upon pivoting of the leading lip 2 do not effect an unpermitted bending of the bolt. The adjustment of the gap otherwise ensues in an analogous manner to the adjusting means for the leading lip in the first exemplary embodiment. In order to effect a pivoting of the upper part of the leading lip 2 in the drawing, one or more lever arms 48 are displaced along the longitudinal axis of the bolt 31 by means of the screw nuts 32. The rigid lever arms 48 then convert the displacement via the bolt 31 into a pivoting movement of the leading lip 2.

The same or corresponding components are also denoted with the same reference signs as in the first exemplary embodiment in the third exemplary embodiment in FIG. 3 so that reference is made here to the explanations in respect of the first exemplary embodiment with regard to these components and the mode of operation of the application unit.

In the following, the adjusting means for the leading lip 2 is now described. As shown in FIG. 4, the leading lip 2 is comb-shaped, i.e. it consists of a web 25, which extends along the length of the application unit 1, and of projections 36 distributed along the length of the web. The individual projections 36 are respectively guided in a flange element 20 in a displaceable manner in the direction of the longitudinal axis 37, the element being securely connected with the cross piece 10. The flange element 20 is provided with through-bores 21 through which the respective adjusting screws 22 are inserted. As in the first exemplary embodiment, the flange element 20 is formed of two partial elements securely connected to each other and which surround shoulder 23 of each adjusting screw 22 so that this shoulder is supported on the flange element. In order to guide the projections 36 of the leading lip 2, guide recesses 38 are formed in the flange element 20, the pressure springs 24 surrounding the adjusting screws 22 respectively being inserted in these guide recesses and biasing apart the projections 36 and the flange element 20. The leading lip 2 is additionally connecting by means of an elastic connecting bar 39 to the cross piece 10.

Analogously to the first exemplary embodiment, a rotation of the adjusting screws 22 in the appropriate direction results in a gap enlargement or reduction, although the leading lip 2 in the present third exemplary embodiment is displaced locally or as a whole in a translatory manner in the direction of the respective longitudinal axis 37 of the projections 36. In this case, the elastic connecting bar 39 ensures that a continuous border wall of the supply channel 7 is always maintained. Since no bending forces arise in this adjusting means at the adjusting screws 22, the flange element 20 and the leading lip 2, relatively large adjusting distances can be realized. The pressure springs 24, which can also be formed as disc springs or the like as in the first exemplary embodiment, guarantee a stable gap setting which is free of play.

Figure 5:
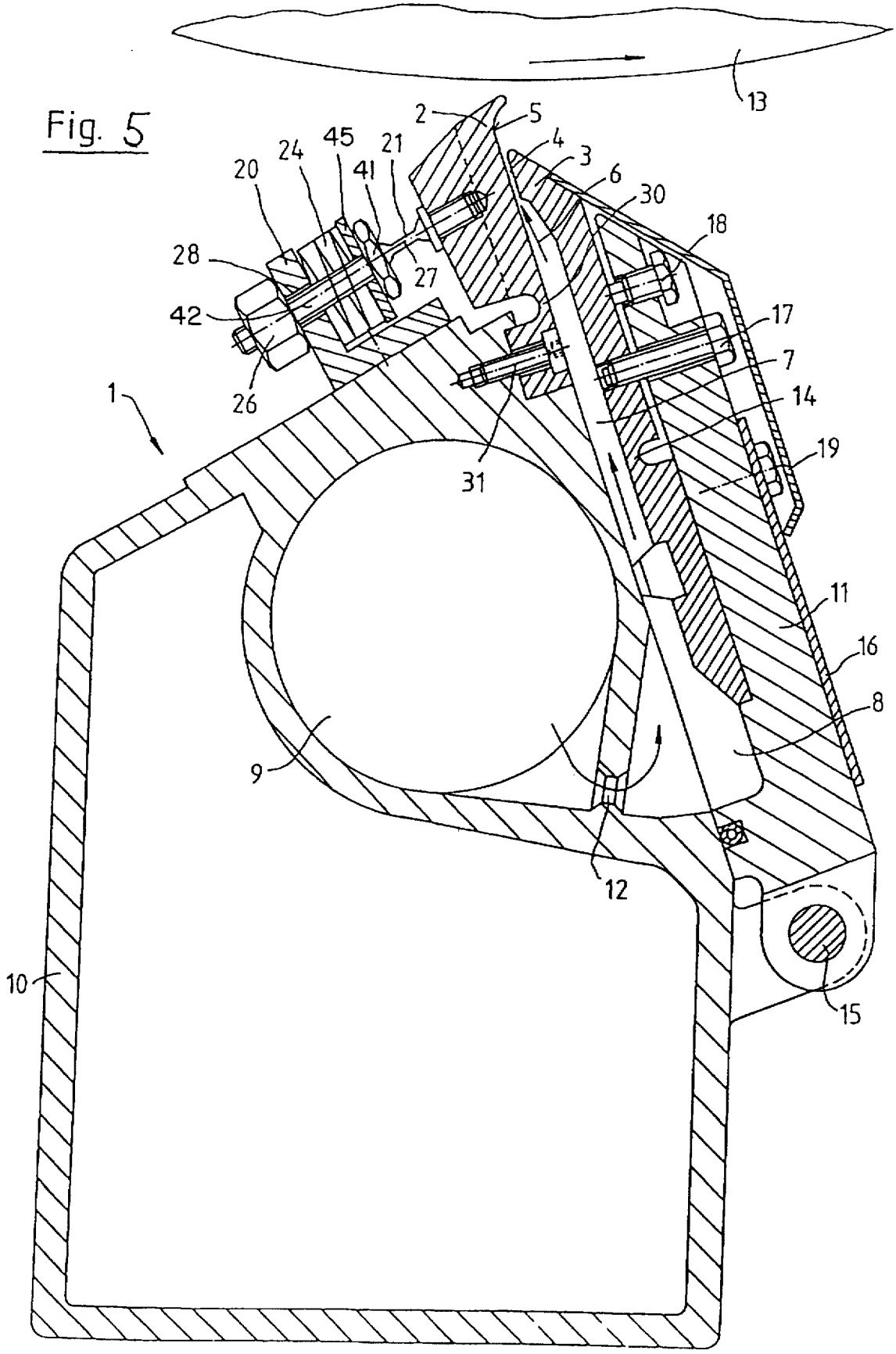
FIG. 5 shows a schematic cross-sectional illustration of a fourth exemplary embodiment of the inventive application unit.

As shown in FIG. 5, according to a fourth exemplary embodiment, the application unit 1 includes a support means which is designed here in the form of a cross piece 10. The cross piece 10 extends the entire length of the application unit. A distribution pipe 9 for the liquid or pasty medium to be applied and which is usually described as an colour distribution pipe is formed in the cross piece 10. An equalizing space 8 is connected to this via through openings 12 and connects with a supply channel. The supply channel 7 opens into a dosing gap 4 which is formed between a leading lip 2 and a trailing lip 3. A concavely curved deflection surface 5 is formed at the free end of the leading lip 2, which extends beyond the free end of the trailing lip 3. The liquid or pasty medium is indicated by arrows 6.

The application unit 1 is associated here with a roll 13 (i.e. an applicator roll in the case of indirect application of the medium to be applied or a support roll surrounded by the material web in the case of direct application). The direction of rotation of the roll 13 is indicated by an arrow. As shown in FIG. 5, the leading lip 2 lies on the side of the dosing gap 4 at which a point on the surface of the roller 13 approaches the dosing gap, i.e. leads in. On the contrary, the trailing lip 3 lies at the opposite side of the dosing gap at which the said point on the surface of the roll 13 moves away from the dosing gap, i.e. trails away.

In this application unit 1, the liquid or pasty medium 6 is initially supplied via the colour distribution pipe 9, then arrives in the equalizing space 8 and flows through the supply channel 7 to the dosing gap 4, out of which the medium is discharged as a free jet, not illustrated. In this case, a deflection of the application jet in the direction of a tangent on the roll 13 takes places by means of the concavely curved deflection surface 5 of the leading lip 2. The liquid or pasty medium 6 is applied in the form of this free jet onto the surface of the roll 13 or directly onto the material web. Usually, a correct coating weight is subsequently doctored by means of a downstream fine dosing device, not shown.

The application unit 1 is equipped both with an adjusting means for the leading lip 2 as well as an adjusting means for the trailing lip 3. The adjusting means for the trailing lip 3 was already described in connection with preceding exemplary embodiments so that reference is made in this regard to these explanations.

Figure 6:
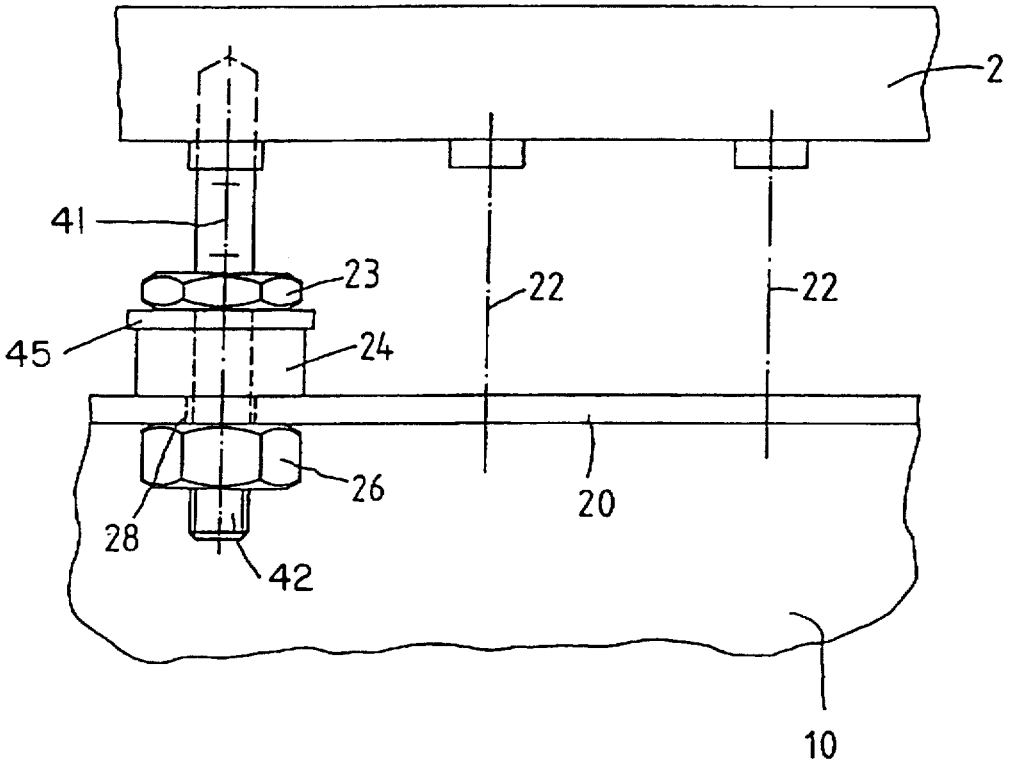
FIG. 6 shows a portion of the top plan view of the fourth exemplary embodiment of the inventive application unit illustrated in FIG. 5.

The adjusting means for the leading lip 2 is now described in the following. A structural component 20 extending along the length of the cross piece 10 is arranged at a fixed location on the cross piece 10 and provided with through-bores 28 for receiving adjusting spindles 42. The adjusting spindles 42 are distributed along the longitudinal extension of the cross piece 10 or the structural component 20, as illustrated in FIG. 6.

The adjusting spindles are securely connected at one end thereof with the leading lip 2 and protected in this case against twisting. For example, the protection against twisting ensues by means of counternuts or otherwise, for example by bonding, not especially illustrated in the drawing.

In front of this, at the end of the adjusting spindle 42 engaging in the leading lip 2, the spindle can be provided with a bending part 22 which is produced in an advantageous manner in the form of a leaf-spring-like thin part. This bending part 22 lies in a plane with the axis of the adjusting spindle 42. The width of the bending or thin part should approximately correspond to the diameter of the adjusting spindle, as can be recognized in FIG. 6 showing the top plan view of the application unit, or can even be designed to be somewhat wider. Since this thin part is therefore wide and, on account of its leaf-spring-like small thickness, only has a small bending resistance, it is therefore capable of elastic deformation about an axis 27 extending parallel to the longitudinal axis of the application unit 1. On the one hand, this provides the advantage that a type of pivot is provided by means of the bending part 22 which (in the case of displacement of the lip 2) permits an alteration essentially without resistance of the angle between the lip 2 and the axis of the adjusting spindle 42 (supported in the structural component of fixed location). On the other hand, a large cross-sectional area is provided by the leaf-spring-like thin part which is suitable for transferring greater forces onto the leading lip 2 then up to now when setting the gap. This is particularly advantageous when the leading lip 2 consists of relatively rigid material.

Figure 7:
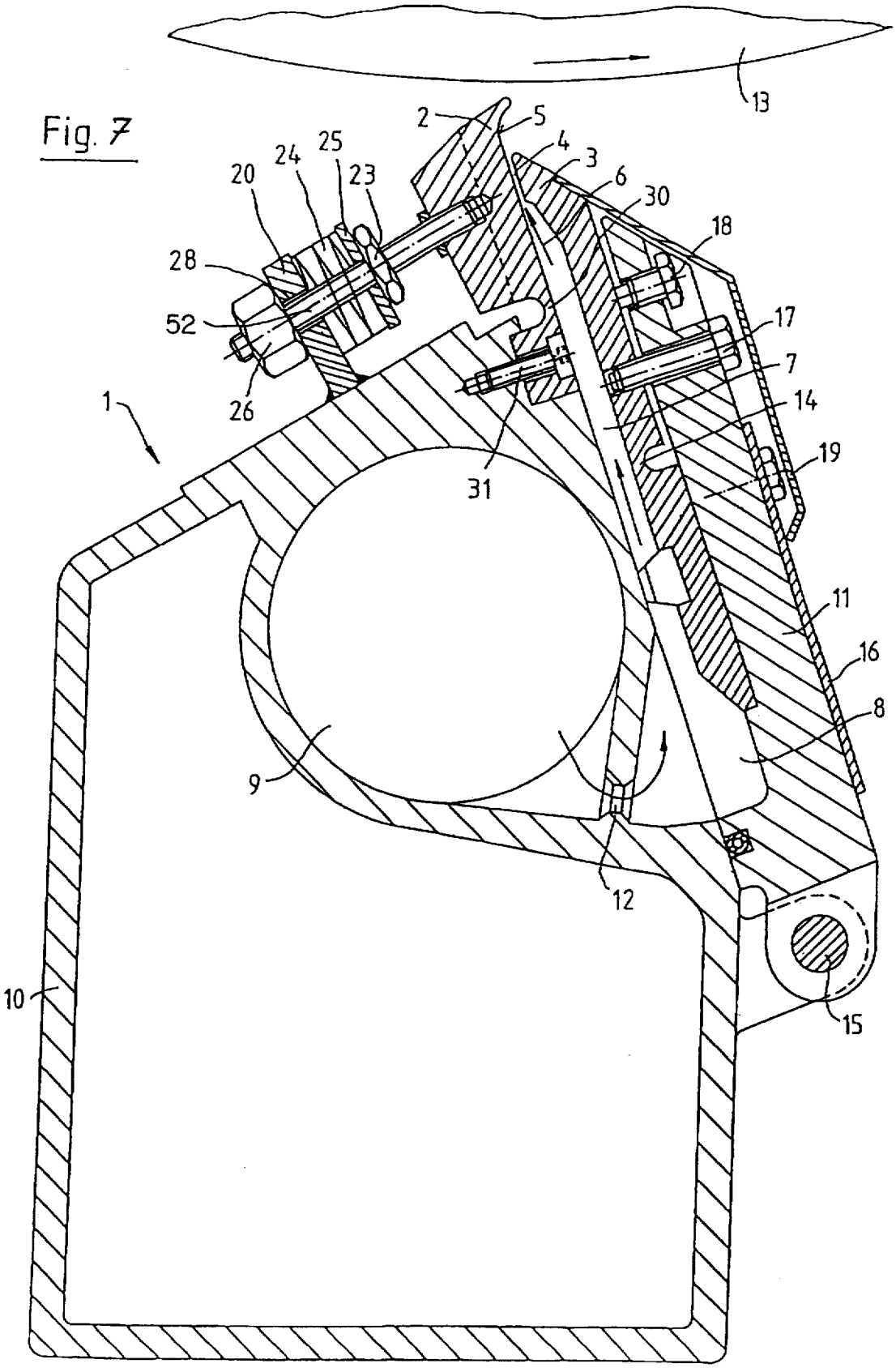
FIG. 7 shows a schematic cross-sectional illustration of a fifth exemplary embodiment of the inventive application unit.

As a fifth exemplary embodiment according to FIG. 7 shows, the adjusting spindle 52 can obviously also be made without a bending part. This makes sense in the case where the leading lip 2 forms a less rigid bar and smaller forces are to be transferred there for profiling the gap 4.

The adjusting spindle 52 additionally has a spring element 24, only schematically shown, which preferably consists of disc springs.

The spring element 24 can be biased with respect to the structural component 20 by means of a pretensioning nut 26 and a pressure piece 25, on account of which a freely selectable biasing of the spring element can be set independently of the gap adjustment.

The adjusting spindle 52 is displaceable in the axial direction relative to the supporting cross piece 10 by means of an adjusting device 26. A nut 26 screwed onto the other end of the adjusting spindle 22 can be used as an adjusting device. The nut 26 acts from the opposite side (i.e. opposite to the lip 2) on the structural component 20. The structural component 20 can be designed as a bracket secured on the cross piece 10, as shown, for example, in FIG. 5. However, it can also be a bar which is, for example, welded onto the cross piece 10, as follows from FIG. 7.

When tightening the adjusting nut 26, the spring element 24 is compressed. In this manner, the lip 2 is pulled back to the amount by which the spring bundle is compressed and the dosing gap 4 is thus enlarged. If the adjusting spindle 22 has a thin part as illustrate in FIGS. 5 and 6, this experiences a slight bending deformation about the axis 27 on account of its elasticity, on account of which unpermitted deformations of the spindle 52 can be avoided.

When loosening the nut 26, the spring element 24 is relaxed. The leading lip 2 moves back to the amount by which the spring element is relaxed with respect to its biasing and thus makes the dosing gap 4 smaller. Stated in other words, the adjusting spindle 52 is acted upon in the direction of "closing" the dosing gap 4. If the elastic thin part 21 is present, this in turn experiences a slight bending deformation, but in the opposite direction or into its initial position.

For the leading lip 2 to be adjusted, it is provided with a thin part 30 which can also be a pivot. The part of this lip lying above the thin part in the drawing is therefore capable of being pivoted within a certain range. The lip 2 is mounted to the beam 10 by means of fastening screws 31.

On account of the previously described tightening or loosening of the nut 26 of individual or all adjusting spindles 52, local sections of the leading lip 2 or the entire leading lip 2 are pivoted either away from the trailing lip 3 or towards this.

The same effect can also be achieved by means of a reversed arrangement of the biasing nut 23 and the adjusting nut 26. In this variation, the nut 23 with the pressure piece 26 is located at the free end of the adjusting spindle 52. A spring element 24 is again arranged between the pressure piece 25 and the fixed structural component 20. The adjusting nut 26, which now faces the lip 2 in this variation, acts against the structural component 20.

The adjustment for the trailing lip 3 is provided for the elimination of tolerances in the gap width of the dosing gap 4 resulting from manufacture, whereas the adjusting means for the leading lip 2 serves to profile the gap width of the dosing gap 4.

The adjusting spindle 52 is therefore provided with a fine thread which permits a precise fine adjustment.

By means of the inventive apparatus according to the fourth and fifth exemplary embodiments, an even more sensitive adjustment of the leading lip which is free of play can be carried out than in the solution according to FIG. 1. Additionally, a compensation of angular changes during the adjustment can take place on account of which the adjustment spindles are acted upon less upon bending.

We claim:

1. An application unit for the direct or indirect application of a liquid or pasty medium (6) onto a moving material web, comprising:

a dosing gap (4) formed as a free jet nozzle which is formed between a leading lip (2) and a trailing lip (3) mounted on said unit adjacent said moving material web, and adjusting means operatively connected to the leading lip (2) for selectively adjusting each of a plurality of sections of the leading lip disposed along the length of the application unit (1) to vary the of each section from the trailing lip (3), wherein the adjusting means has a mechanical adjusting mechanism and wherein the mechanical adjusting mechanism has a lever arm arrangement (48) which introduces bending forces in the leading lip (2) by means of adjusting members (31–34) which are distributed along the length of the application unit (1) in order to adjust the dosing gap (4) by means of the resulting bending deformations of each section of the leading lip.

2. An application unit according to claim 1, characterized in that the leading lip (2) has at its free end a concavely curved deflection surface (5) for the liquid or pasty medium (6).

3. An application unit according to claim 1, characterized in that the leading lip (2) is comb-shaped (35, 36).

4. An application unit according to claim 1, characterized in that each section of the leading lip (2) is moveable selectively in a rotary manner about an axis extending parallel to a longitudinal axis of the application unit (1).

5. An application unit according to claim 1, characterized in that each section of the leading lip (2) is moveable selectively in a translatory manner in a direction (37) extending transversely to the plane of the dosing gap (4).

6. An application unit according to claim 1, characterized in that the mechanical adjusting mechanism has a number of adjusting screws (22) distributed along the length of the application unit (1), said adjusting screws being respectively supported directly or indirectly on a cross piece(10) of the application unit and in threaded engagement with the leading lip (2), the adjusting screws (22) being biased by a spring element (24).

7. An application unit according to claim 1, characterized in that in addition to adjusting means for the leading lip (2), a second adjusting means (14, 17, 18) is operatively connected to the trailing lip (3) for selectively adjusting each of a plurality of sections of the trailing lip (3) disposed along the length of the application unit (1) to vary the distance of said section from the leading lip (2).

8. An application unit according to claim 7, characterized in that the adjusting means for the leading lip (2) is designed for a fine adjustment of the dosing gap (4) and the additional adjusting means (14, 17, 18) for the trailing lip (3) is designed for a coarse adjustment of the dosing gap (4).

9. An application unit for the direct or indirect application of a liquid or pasty medium (6) onto a moving material web, comprising a dosing gap (4) formed as a free jet nozzle which is formed between a leading lip (2) and a trailing lip (3) mounted on said unit adjacent said moving material web, wherein the leading lip (2) is connected with a plurality of adjusting spindles in a plurality of sections of the leading lip distributed along the length of the application unit (1) and the leading lip (2) is selectively adjustable in each section alone the length of the application unit (1) to vary the distance of each section from the trailing lip (3), each adjusting spindle is rigidly connected to the leading lip (2) and in a manner protected against twisting, each adjusting spindle is capable of adjustment in an axial direction relative to a supporting means of the application unit (1) by means of an adjusting means, and each adjusting spindle has a bending part (21).

10. An application unit according to claim 9, characterized in that the bending part (21) is in the form of a leaf-spring-like thin part.

11. An application unit according to claim 10, characterized in that the wide side of the leaf-spring-like thin part extends along the horizontal axis of the adjusting spindle, the thin part being elastically deformable about an axis (27) extending parallel to the longitudinal axis of the application unit (1).

* * * * *